US006862987B2

(12) United States Patent
Kitahara et al.

(10) Patent No.: US 6,862,987 B2
(45) Date of Patent: Mar. 8, 2005

(54) POROUS RESIN STAMP

(75) Inventors: Shigeru Kitahara, Osaka (JP); Yasuo Nagasawa, Osaka (JP); Yuji Tanaka, Sakai (JP); Yoshitomo Tanaka, Sakai (JP)

(73) Assignee: Sunlux Corporation, Tennoji-ku (JP)

( * ) Notice: Subject to any disclaimer, the term of this patent is extended or adjusted under 35 U.S.C. 154(b) by 0 days.

(21) Appl. No.: 10/647,735

(22) Filed: Aug. 20, 2003

(65) Prior Publication Data

US 2004/0083912 A1 May 6, 2004

Related U.S. Application Data

(63) Continuation-in-part of application No. 09/764,980, filed on Jan. 16, 2001, now Pat. No. 6,645,418.

(51) Int. Cl.[7] ..... B41K 1/00
(52) U.S. Cl. ..... 101/327; 101/401.1; 101/401.3
(58) Field of Search ..... 101/327, 401.1, 101/401.3

(56) References Cited

U.S. PATENT DOCUMENTS 5,611,279 A * 3/1997 Ando et al. ..... 101/401.1
5,771,808 A * 6/1998 Kuriyama et al. ..... 101/401.1
5,873,308 A * 2/1999 Taira ..... 101/327
5,979,323 A * 11/1999 Hirano ..... 101/401.1
6,010,767 A * 1/2000 Ando ..... 428/195.1
6,020,053 A * 2/2000 Suda ..... 428/305.5
6,645,418 B2 * 11/2003 Kitahara et al. ..... 264/413

* cited by examiner

*Primary Examiner*—Andrew H. Hirshfeld
*Assistant Examiner*—Jill E. Culler
(74) *Attorney, Agent, or Firm*—Curtis L. Harrington

(57) ABSTRACT

The present invention relates to a porous resin stamp which can repeatedly seal without supplying ink for a long period of time by beforehand soaking ink therein. The present invention also relates to a cartridge comprising the porous resin stamp and a stamp comprising the cartridge. Colors of the stamp can be intentionally adjusted by adjusting the amount of heating materials combined or the mixing rate of heating materials. Thus, it is possible to precisely check the desired letters, designs, patterns and so on. Furthermore, it is possible to intentionally adjust efficiency rate of heat generation of the heating materials by suitably changing the amount of heating materials. This makes it possible to express any small letters, minute designs and patterns with high reproducibility.

12 Claims, 8 Drawing Sheets

(a)

(b)

POROUS RESIN STAMP

This application is a Continuation-in-part of U.S. patent application Ser. No. 09/764,980 filed Jan. 16, 2001 now U.S. Pat. No. 6,645,418.

BACKGROUND OF THE INVENTION

1. Field of the Invention

The present invention relates to a porous resin stamp, which can repeatedly make a seal impression without supplying ink for a long period of time such as by soaking the stamp in ink before use.

2. Description of the Related Art

There is a porous resin stamp known simply as a stamp, which can repeatedly make a seal impression without supplying ink each time by beforehand soaking ink into the stamp. A porous resin stamp is comprised of porous resin having open cells through which ink is supplied onto the stamp surface, thus, it is possible to repeatedly make a seal impression.

As for a method for producing such porous resin stamps, a stamp manufacturing process by a making a thermal head, a stamp manufacturing processing by the use of a flashing light, and a thermal transfer method and such are known. This stamp manufacturing processing by a flashing light is a method to irradiate light such as infrared light toward a surface of a porous resin body so that heating material is made to be negatives, i.e., complements to desired letters, designs, patterns and such by generating heat, and to form ink inexuding portion and ink exuding portion by melting the surface layer of the porous resin body.

As a concrete example of the stamp manufacturing processing by a flashing light, is a porous resin stamp wherein open cells are filled by melting a surface of the porous resin body by making and locating a black pigment to generate heat with an irradiating light directed onto the surface of the porous resin body, which is layered with a layer beforehand combined with predetermined amount of black pigment or with a layer of which surface comprised of black pigment, is disclosed in a publication of Japan patent application Tokuganhei 9-314972.

However, the above mentioned existing porous resin stamp has the following problems. The porous resin stamp disclosed in the publication of Japan patent application Tokuganhei 9-314972 was inferior in reproducibility, particularly of thin lines and spots, because this porous resin stamp only comprised black pigment as a heating material, of which heat conductivity was high, and thus, irradiated part and the surrounding porous resin body became melted when melting the porous resin body with generated heat from the heating of the heating material by irradiating light.

Also, in a case of a porous resin stamp soaked only in black pigment, the porous resin stamp became only one color, black. For example, in a case of soaking the stamp in black ink which is used most frequently, it became difficult to discern the ink and the desired letters, designs, patterns and such formed on the stamp surface, and consequently, it was difficult to distinguish the top and bottom and the right and left of the stamp surface. Further, it was difficult to find a stain impression adhered, thus, it was inconvenient to use.

Moreover, since the porous resin body and an original being directly in contact were irradiated with light when producing the porous resin stamp, there might be some cases where the melted porous resin body and the heating material could have beforehand combined with the porous resin body and could have become adhered to the original. Therefore, the problem was that the original itself could not be re-used directly when producing the same stamp.

BRIEF SUMMARY OF THE INVENTION

The present invention is to solve the above mentioned problems of the prior arts. The invention relates to a porous resin stamp comprising a porous resin body having a heating material volumetrically combined within said porous resin body, said heating material including at least phthalocyanine pigment within both an unmelted portion of the surface of the porous resin body for assisting in flow of ink within said porous body and within an ink inexuding melted portion of the porous body.

The invention also relates to a porous resin stamp comprising a porous resin body having a layer of porous heating material covering on at least a first surface of said porous resin body, said layer of porous heating material including at least phthalocyanine pigment within both an unmelted portion of said layer of porous heating material layered on said first surface of said porous resin body for assisting in flow of ink through said layer of porous heating material and an ink inexuding melted portion of the porous body.

The invention also relates to a porous resin stamp wherein said heating material further comprises carbonic particles.

The invention also relates to a porous resin stamp wherein said composition ratio of said carbonic particles and said phthalocyanine pigment is in the weight ratio of from about 0.1:1.0 to about 5.0:1.0.

The invention also relates to a cartridge comprising one of the porous resin stamps mentioned above, an ink-storing material and a cover of the cartridge.

The invention also relates to a stamp comprising one of the cartridges mentioned above and a holding part of said cartridge.

BRIEF DESCRIPTION OF THE DRAWINGS

FIG. 2 is a sectional view of a porous resin body with a heating material layered on.

Figure 6:
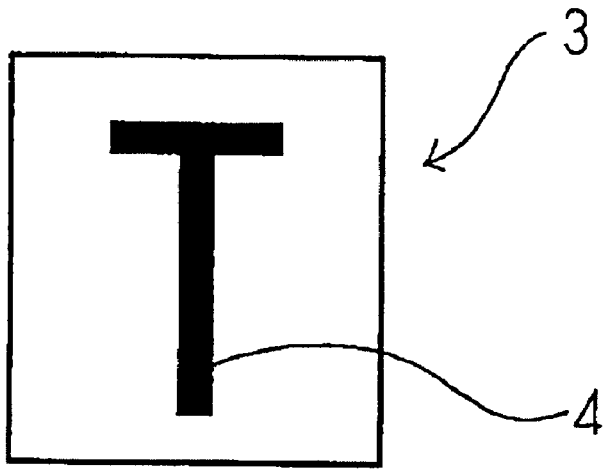
Figure 6:
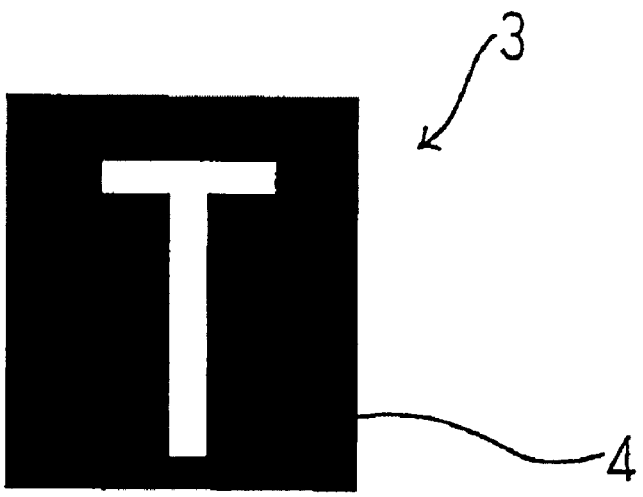

Both (a) and (b) of FIG. 6 are plan views showing the preferred embodiments of an original.

Figure 7:
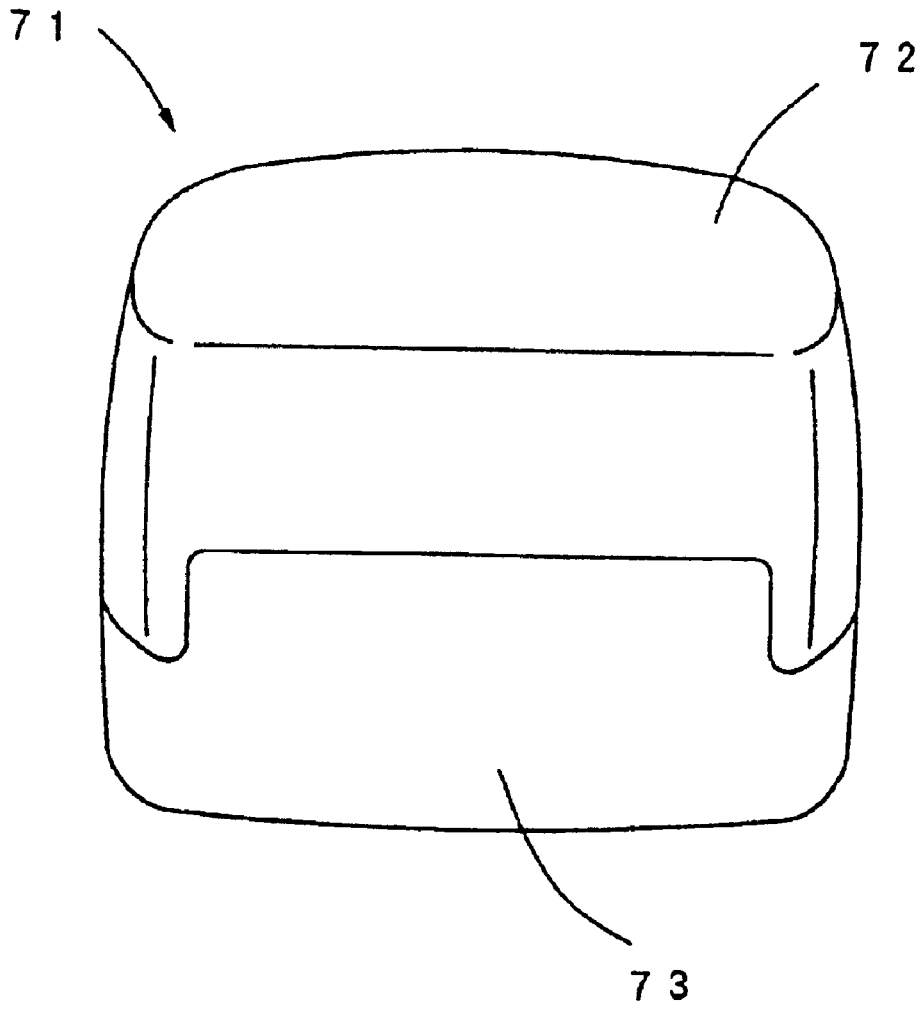

FIG. 7 is a schematic description diagram of one of realistically and commercially available examples of the present invention.

Figure 8:
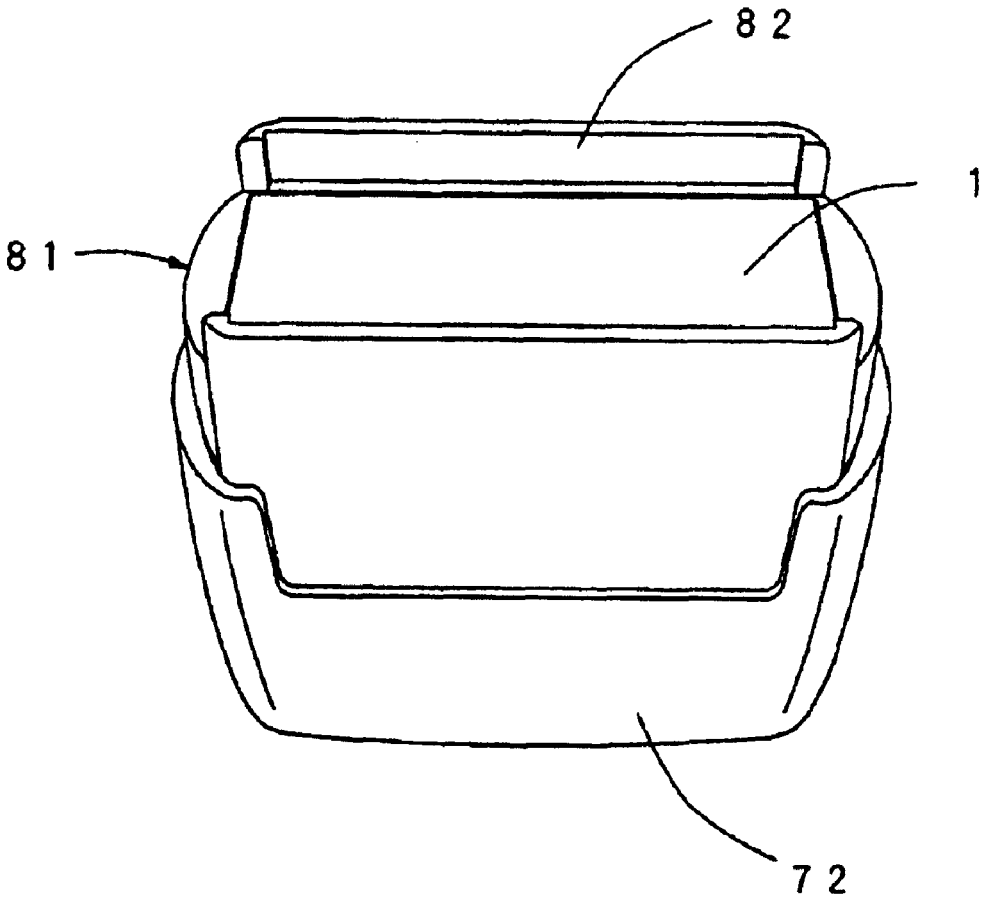

FIG. 8 is a schematic description diagram of a stamp shown in FIG. 7 of shown with the cover taken off the and which is put on in an upside-down state.

Figure 9:
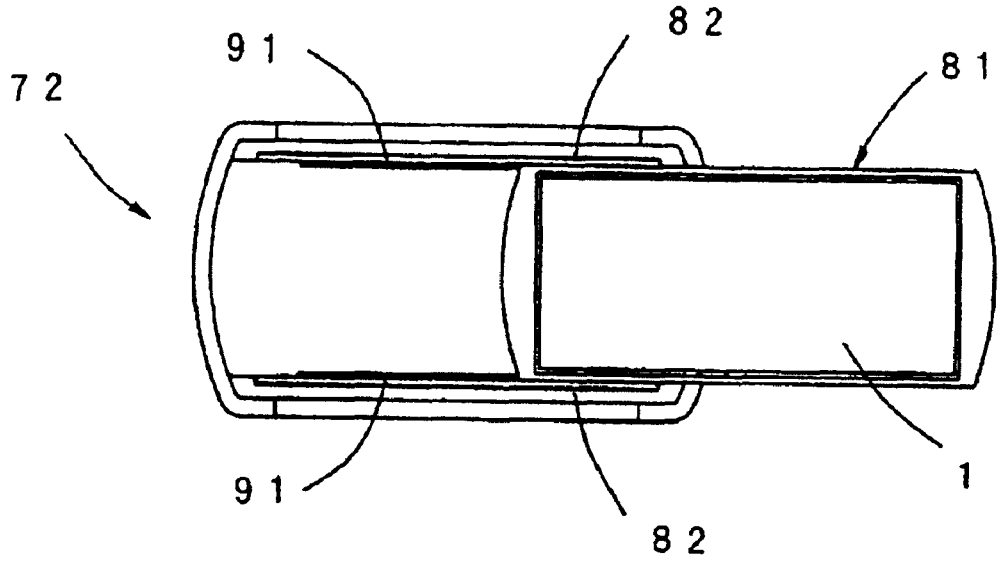

FIG. 9 is a schematic description diagram of a stamp shown in FIG. 8 which is looking down from right above view point and the cartridge is sliding out from the stamp-holding part.

Figure 10:
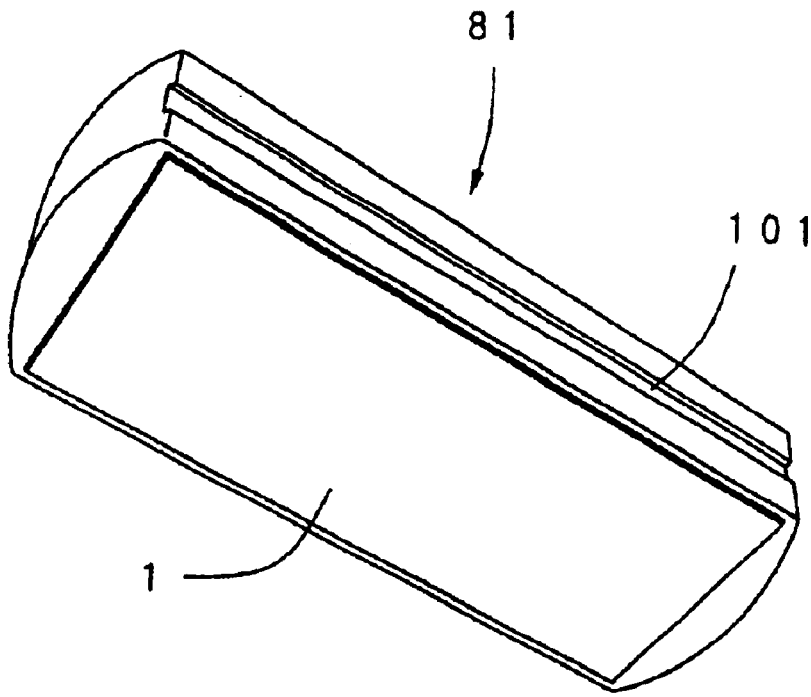

FIG. 10 is a schematic description diagram of a cartridge of a stamp shown in FIGS. 7, 8 and 9.

Figure 11:
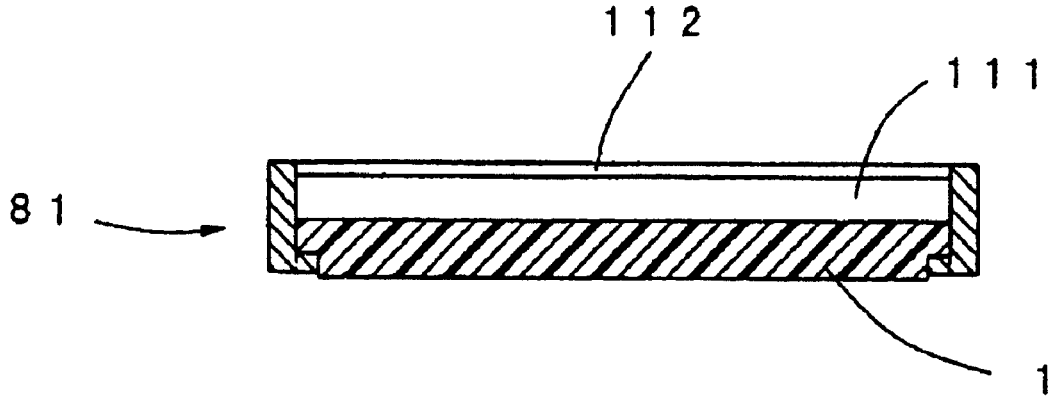

FIG. 11 is a sectional view of the cartridge of a stamp shown in FIGS. 7, 8 and 9.

DESCRIPTION OF PREFERRED EMBODIMENTS OF THE INVENTION

Figure 1:
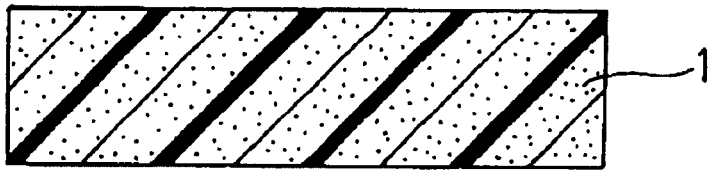
FIG. 1 is a sectional view of a porous resin body combined with a heating material.
Figure 2:
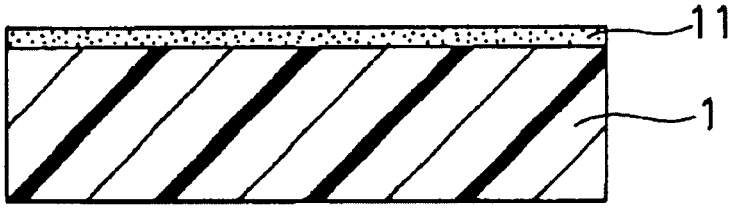
Figure 3:
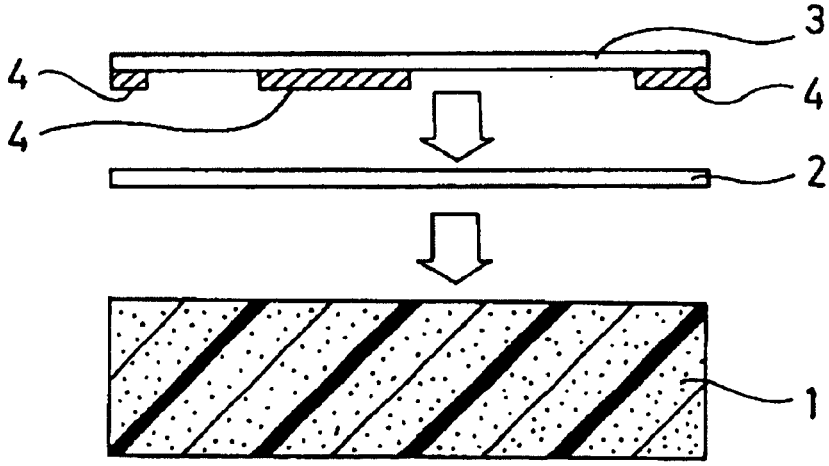
FIG. 3 is a schematic description diagram showing a condition of a porous resin stamp combined with a heating material and an original, which are layered and put together via a light transmittable film.
Figure 4:
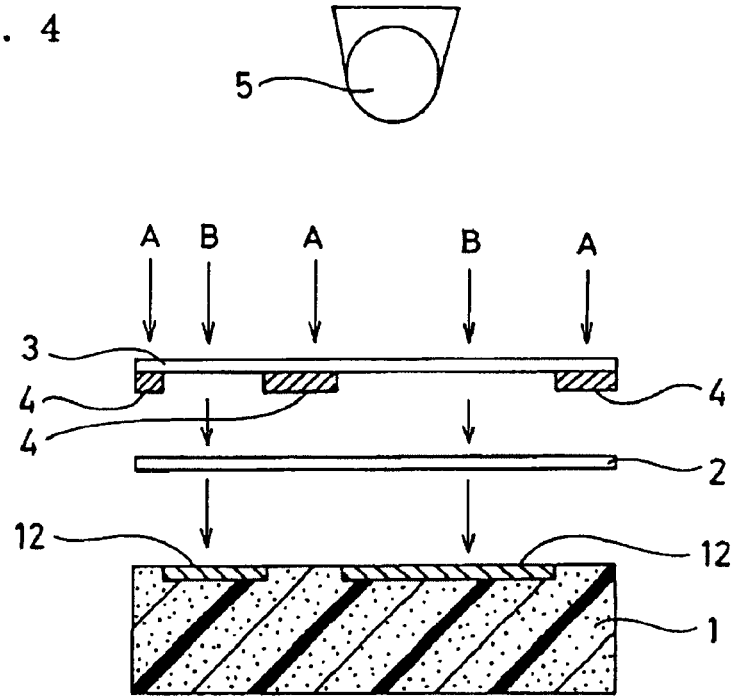
FIG. 4 is a schematic description diagram of a producing method of a porous resin stamp in a case of using a porous resin body shown in FIG. 1.
Figure 5:
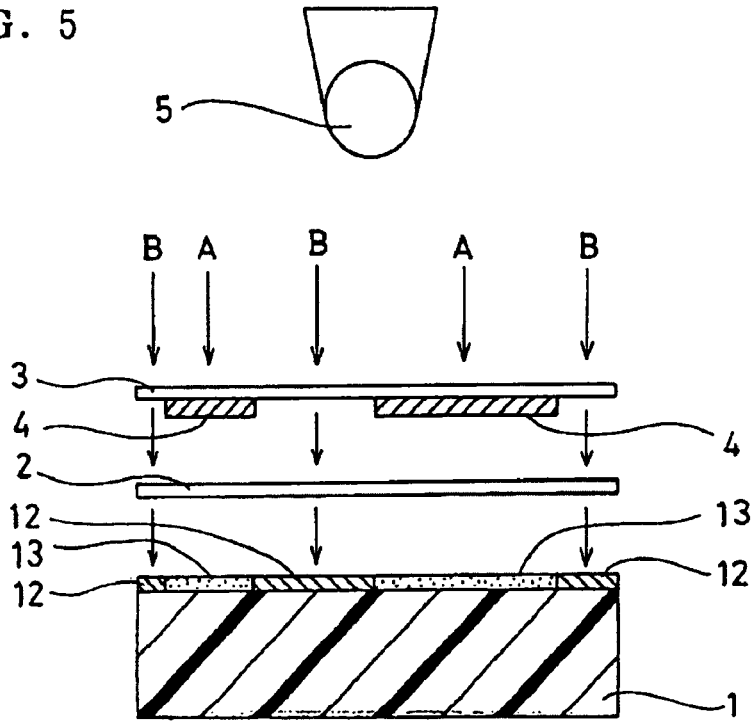
FIG. 5 is a schematic description diagram of a producing method of a porous resin stamp in a case of using a porous resin body shown in FIG. 2.

The porous resin stamp of the present invention will be explained hereinafter with references made to the drawings. FIG. 1 is a sectional view of a porous resin body combined with a heating material, and FIG. 2 is a sectional view of a porous resin body with a heating material layered on its surface. FIG. 3 is a schematic description diagram showing a condition of porous resin stamp combined with heating material and an original, which are layered and put together via a light transmittable film. FIG. 4 is a schematic description diagram of a producing method of a porous resin stamp in a case of using a porous resin body shown in FIG. 1. FIG. 5 is a schematic description diagram of a producing method of a porous resin stamp in a case of using a porous resin body shown in FIG. 2. Sub Figures (a) and (b) of FIG. 6 are plan views showing the preferred embodiments of an original. FIG. 7 is a schematic description diagram of one of realistically and commercially available examples of the present invention. FIG. 8 is a schematic description diagram of a stamp shown in FIG. 7 of which the cover is taken off the and which is put on in upside-down state. FIG. 9 is a schematic description diagram of a stamp shown in FIG. 8 looking down from right above view point and with the cartridge sliding out from the stamp-holding part. FIG. 10 is a schematic description diagram of a cartridge of a stamp shown in FIGS. 7, 8 and 9. FIG. 11 is a sectional view of the cartridge of a stamp shown in FIGS. 7, 8 and 9.

The porous resin stamp of this invention comprises a porous resin body and a heating material. The heating material is volumetrically combined within said porous resin body or layered on at least a first surface of said porous resin body. If light is irradiated to the surface of the porous resin body, the surface melts because of the heating materials and forms an ink inexuding portion.

The heating material includes at least phthalocyanine pigment within both a melted and an unmelted portion of the surface of the porous resin body. The heating material can further comprise carbonic particles.

A composition ratio of said carbonic particles and said phthalocyanine pigment is in the weight ratio of from about 0.1:1.0 to about 5.0:1.0.

To produce the porous resin stamp of the present invention, firstly, a porous resin body (1) is combined with heating material shown in the FIG. 1 preparation, or a porous resin body (1) with a layer (11) of heating material on a part or all of the front surface shown in FIG. 2 is prepared.

As for the porous resin body (1) used, there is no particular limitation, as long as it can be melted with generated heat of the below mentioned heating material and is an open cell structure having ink-resistance. Concretely speaking, polyolefinic resin such as polyethylene, polyamide, polyurethane, polyacetal, polystyrene and polypropylene, or thermoplastic resin such as ethylenevinylalcohol (EVA) can be exemplified.

The percentage of voids of porous resin body (1) used is not particularly restricted, however, as it is 40–80%, more preferably 50–70%. Moreover, the diameter of cell of open cell is not particularly restricted, however, it is below 50 $\mu$m, more preferably 5–30 $\mu$m.

The density of porous resin body (1) used is not particularly restricted, however, it is 0.2–0.6 g/cm$^3$, preferably 0.3–0.5 g/cm$^3$. Moreover, the melting point thereof is not particularly restricted, however, it is 60–120° C., preferably 70–110° C.

Further, a method for forming the open cell structure in the porous resin body (1) is not particularly restricted, for example, a forming method wherein an agent to form pores, such as calcium carbonate, magnesium carbonate, polyhydric alcohol, salt, sugar, starch, hemicellulose and tetramethylmethane, monomers of polyhydric alcohol such as polyalkylene glycol and diethylene glycol, or an accelerator of the agent to form pores, such as polymers, are kneaded in material of porous resin. After forming by adding additives in need, such as plasticizer like dioctyl phthalate, dioctyl adipate and Vulkanol 88 (Tradename; Bayer, a German company), the agent to form pores is dissolved and removed with solvent that can be dissolved in water, such as water, low aliphatic alcohol, dilute acidic water and dilute alkalic water. Additionally, porous resin body (1) with open cell structure formed by other methods can be suitably used.

As for the heating material, phthalocyanine pigments such as copper phthalocyanine blue B and copper phthalocyanine green are used, and it is more preferable to combine carbonic particles such as carbon black in addition to the phthalocyanine pigments.

The reason for using the phthalocyanine pigments is that it is outstanding in reproducibility of small letters, designs, patterns and dots compared with a case for using blackish heating material such as carbonic particles, for example. Also with the heating material, a color of heated parts becomes different from a color of an unheated part, so it is possible to readily check the result of stamp by comparing the ink inexuding parts formed on the stamp surface and the desired letters, designs, patterns and such. Further, when producing stamps, it is possible to easily check the progression of how much the ink inexuding parts are formed.

Moreover, the reason for preferably using a mixture of the carbonic particles and the phthalocyanine pigments is that it is possible to easily obtain a heating effect suitable for each of the cases wherein the desired letters, designs and patterns are minute or rough, by adjusting a combination rate thereof. In other words, when it is rough, the combination amount of carbonic particles are increased to obtain a high heating effect, and when it is minute, the combination amount of carbonic particles are lowered to made it heat gently. Further, by varying the combination amount of phthalocyanine pigments to change the color of heating material, it is possible to distinguish the color of ink spread out from the ink exuding parts and the color of ink inexuding parts. For example, by making it green with pigments of carbon and phthalocyanine blue, it is easy to distinguish with blackish and reddish inks. Additionally, when making dark brown by adjusting the combination, it is possible to easily distinguish with inks of black, purple, blue, red and such.

When using the carbonic particles and the phthalocyanine pigments combined together, the combination rate is not particularly restricted, however, it is weight ratio 0.1:1.0–0.1:5.0, more preferably, 0.5:1.0–3.0:1.0. Further, particle diameter of the carbonic particles and the phthalocyanine pigments are not particularly restricted, however, it is below 20 $\mu$m, more preferably, 5–10 $\mu$m.

Apart from the above description, a heating material which can generate enough heat to melt said porous resin body (1) by being irradiated light from the light source (5) can also be suitably and optionally combined. Concretely speaking, metal oxides, metals, nitroso compound, cyanine coloring matter, thiol nickel complex, napthoquine pigment, anthraquine pigment and such can be exemplified, and one of or a mixture of more than two of these can be used.

The particle diameter of said heating material is not particularly restricted, however, it is typically below 20 $\mu$m, more preferably, 5–10 μm. A method for preparing the porous resin body (1), which is combined with the heating material shown in FIG. 1, is not particularly restricted. For example, a method wherein the porous resin body (1) is formed after dispersing resin material being beforehand combined with the heating material, can be exemplified. In this case, the amount of the heating material to be combined is not particularly restricted, however, it is typically 0.2–15 weight percent to the porous resin body, more preferably, 0.4–10 weight percent.

Additionally, the method for forming the porous resin body is not particularly restricted, and a compression molding, an extrusion molding, an injection molding and such can be exemplified.

Also, a method for preparing the porous resin body (1) of which front surface is covered with a layer (11) of the heating material shown in FIG. 2 is not particularly restricted, and a method for applying the heating material by diluting with solvent such as alcohol can be exemplified. The thickness of a layer of heating material layered on the surface of the porous resin body (1) is not particularly restricted, but it is over 50 μm.

Next, as shown in FIG. 3, the porous resin body (1) combined with the heating material and an original (3) are put together via a light transmittable film (2). Or, the porous resin body (1) of which front surface is covered with a layer of the heating material and an original (3) are put together via a light transmittable film (2).

The original (3) is constructed so that it can selectively pass the irradiated light. In a case of the illustrated example, the original (3) is comprised of a light transmittable material of which surface comprises positive drawings of the desired letters, designs, patterns and such drawn with a light non-transmittable material (4). For example, if a porous resin stamp for sealing a letter "T" is to be produced, the original (3) wherein a letter "T" is drawn with the light non-transmittable material (4), as shown in FIG. 6, should be prepared. Also, if a porous resin stamp for sealing a letter "T" in void is to be produced, the original (3) wherein a letter "T" is drawn in void with the light non-transmittable material (4), as shown in FIG. 6, should be prepared. Then, as shown in FIG. 3, the original (3) is put together with the light transmittable film (2) so that the surface of the original (3), wherein the desired letters, designs, patterns and such are drawn, contacts thereto.

It is also possible to draw complements of the desired letters, designs, patterns and such on the surface of the original (3) with the light non-transmittable material (4). In this case, the original (3) is put together with the light transmittable film (2) so that the opposite surface to the surface of the original (3), wherein the complements of the desired letters, designs, patterns and such are drawn, contacts thereto. Additionally, in this case, it is possible to put the opposite surface to the surface of the original (3), wherein the complements of the desired letters, designs, patterns and such are drawn, against the porous resin body (1) to contact thereto without inserting the light transmittable film (2).

The light non-transmittable material (4) used is not particularly restricted, and a carbon toner and such can be exemplified. Also, a method for drawing the desired letters, designs, patterns and such on the surface of the original (3), and methods such as printing by a thermal printer, printing with a silver ribbon and drawing with a felt pen can be exemplified.

The original (3) is comprised of material that can transmit light, such as a plastic film, a plastic sheet and a silver salt film, which can be obtained from polyethylene, polypropylene, polyester, polyvinyl chloride, polyvinylidence chloride and such, can be exemplified, however, it is not particularly restricted.

The thickness of the original (3) is not particularly restricted, however, it is 10–100 μm, more preferably 10–80 μm. The cases for using the light transmittable original (3) to which the desired letters, designs, patterns and such are drawn with the light non-transmittable material (4) have been described heretofore, however, the original (3) is not particularly restricted, as long as it can selectively pass light through. For example, it is possible to use the original (3) which is cut out in shapes of the desired letters, designs, patterns and such and the complements thereof from light non-transmittable sheets, thick papers and so forth.

The light transmittable film (2) being present in between the original (3) and the porous resin body (1) is used so that the porous resin body (1) and the original (3) can be easily taken off after irradiating with light. As for such a light transmittable film (2), it is not particularly restricted, as long as it transmits light, for example, a plastic film, a plastic sheet and a silver salt film, which can be obtained from polyethylene, polypropylene, polyester, polyvinyl chloride, polyvinylidence chloride and such.

The thickness of the light transmittable film (2) is not particularly restricted, however, it is 10–100 μm, more preferably 10–50 μm.

Next, as illustrated in FIG. 4 and FIG. 5, light is irradiated from the light source (5) on the side of the original (3) toward the surface of the porous resin body (1). As for such a light source (5) used, it is not particularly restricted, as long as it can melt the surface layer of the porous resin body (1) by making the heating material generate heat, for example, a flash lamp, a strobe lamp and such can irradiate light such as infrared light.

The strength of the light is not particularly restricted, as long as it is strong enough to make the heating material generate heat sufficiently.

Additionally, due to the convenience for explanation, there is some space between the porous resin body (1) and the light transmittable film (2), and the light transmittable film (2) and the original (3) in FIG. 4 and FIG. 5, however, in a case of irradiating light in reality, these are closely adhered.

Among the irradiated light reached onto the surface of the original (3), the light irradiated onto the drawing parts of the desired letters, designs, patterns and such (A in the figure) can not pass through the original (3). On the other hand, the light irradiated onto the non-drawing parts of the desired letters, designs, patterns and such (B in the Fig.) can not only pass through the original (3) but reach onto the porous resin body (1) though the light transmittable film (2). The light that can reach onto the surface of the porous resin body (1) is the light passed though the original (3) to which the desired letters, designs, patterns and such (or the complements thereof) are drawn with the light non-transmittable material (4). In other words, as shown in FIG. 4, if the porous resin body (1), which is combined with the heating material, is used, the light reaching the surface of the porous resin body (1) makes the heating material layered on the surface of the porous resin body (1) generate heat, so that the surface layer portion of the porous resin body (1) becomes melted to form ink inexuding portions (12). On the surface layer of the porous resin body (1), the parts excepting the part at where the ink inexuding portions (12) are formed become ink exuding portions (13).

This is how a porous resin stamp comprising the ink exuding portions (13) formed to be the complements of the desired letters, designs, patterns and such, and the ink inexuding portions (12) formed to be not only the complements but negatives of the desired letters, designs, patterns and such, on the stamp surface, is produced.

As for one of realistically and commercially available examples of the present invention, a stamp (71) shown in FIG. 7 is exemplified. The stamp (71) is comprised of a stamp-holding part (72) and its cover (73) in FIG. 7. The stamp-holding part (72) is a complex entity as described below. The cover (73) is to prevent a porous resin body inside the stamp-holding part (72) from making seals on undesired things. The cover (73) is also to make the stamp (71) stand.

Taking off the cover (73) and putting on the stamp-holding part (72) of FIG. 7 in upside-down state, the stamp-holding part (72) would look as shown in FIG. 8. A porous resin body (1) is set in a cartridge (81). The cartridge (81) is a complex entity as described below. Foot parts (82) are pushed and kept still by a spring(s) inside of the stamp-holding part (72). Therefore, the foot parts sink into the inside of the stamp-holding part (72) if the stamp is sealed. Thus, the foot parts (82) are to pre-determine an area to be sealed.

Looking down at the stamp-holding part (72) of FIG. 8 from a right above view point and sliding out the cartridge (81) from the stamp-holding part (72), the stamp-holding part (72) and the cartridge (81) would look as shown in FIG. 9. Shown in FIG. 9, the cartridge (81) is set along ditches (91) of the stamp-holding part (72). FIG. 10 shows the cartridge (81) taken apart from the stamp-holding part (72). A ditch (101) is a counterpart of the ditch (91) of FIG. 9. Needless to say, another ditch is on the opposite side of the cartridge (81). FIG. 11 shows a sectional view of the cartridge (81). The cartridge (81) has a three-layer structure, the porous resin body (1), ink-storing material (111) and a cover (112) of the cartridge (81).

As described heretofore, since the porous resin stamp of the present invention uses the phthalocyanine pigments as a heating material, it is possible to intentionally adjust colors of the stamp by adjusting the amount of heating materials combined or the mixing rate of heating materials, thus, it is possible to precisely check the desired letters, designs, patterns and such on the stamp surface. Therefore, it becomes easy to distinguish stamps and to check the top and bottom, the right and left of a stamp surface.

Furthermore, it is possible to intentionally adjust efficiency rate of heat generation of the heating materials by suitably changing the amount of heating materials combined to a porous resin body or the mixing rate of heating materials. This makes it possible to express any small letters, minute designs and patterns with high reproducibility. Also, by inserting a light transmittable film between the porous resin body and an original, it is possible not only to easily peel off the original from the porous resin body, but also to prevent melted part of porous resin from directly adhering onto the original, thus, the original can be readily re-used.

What is claimed is:

1. A porous resin stamp comprising:

a porous resin body having a heating material volumetrically combined within said porous resin body, said heating material including at least phthalocyanine pigment and carbonic particles within both an unmelted portion of the surface of the porous resin body for assisting in flow of ink within said porous body and within an ink inexuding melted portion of the porous body.

2. The porous resin stamp of claim 1 wherein a composition ratio of said carbonic particles and said phthalocyanine pigment is in the weight ratio of from about 0.1:1.0 to about 5.0:1.0.

3. A cartridge comprising the porous resin stamp of claim 2, an ink-storing material and a cover of said cartridge.

4. A stamp comprising the cartridge of claim 3 and a holding part of said cartridge.

5. A cartridge comprising the porous resin stamp of claim 1, an ink-storing material and a cover of said cartridge.

6. A stamp comprising the cartridge of claim 5 and a holding part of said cartridge.

7. A porous resin stamp comprising:

a porous resin body having a layer of porous heating material layered on at least a first surface of said porous resin body, said layer of porous heating material including at least phthalocyanine pigment and carbonic particles within both an unmelted portion of said layer of porous heating material layered on said first surface of said porous resin body for assisting in flow of ink through said layer of porous heating material and an ink inexuding melted portion of the porous body.

8. The porous resin stamp of claim 7 wherein a composition ratio of said carbonic particles and said phthalocyanine pigment is in the weight ratio of from about 0.1:1.0 to about 5.0:1.0.

9. A cartridge comprising the porous resin stamp of claim 8, an ink-storing material and a cover of said cartridge.

10. A stamp comprising the cartridge of claim 9 and a holding part of said cartridge.

11. A cartridge comprising the porous resin stamp of claim 7, an ink-storing material and a cover of said cartridge.

12. A stamp comprising the cartridge of claim 11 and a holding part of said cartridge.

* * * * *